US005983763A

United States Patent [19]

Morris

[11] Patent Number: 5,983,763

[45] **Date of Patent: *Nov. 16, 1999**

[54] DEFLECTOR MECHANISM FOR LIQUID-JET CUTTER

[75] Inventor: Hervy A. Morris, Independence, Mo.

[73] Assignee: Koch Supplies, Inc., Kansas City, Mo.

[ * ] Notice: Under 35 U.S.C. 154(b), the term of this patent shall be extended for 224 days.

[21] Appl. No.: 08/500,315

[22] Filed: Jul. 10, 1995

[51] Int. Cl.[6] ..... B26D 3/00

[52] U.S. Cl. ..... 83/177; 451/87; 451/88; 451/455; 83/24; 83/53

[58] Field of Search ..... 83/177, 24, 53; 451/87, 88, 455

[56] References Cited

U.S. PATENT DOCUMENTS

| | | | |
|---|---|---|---|
| 3,756,106 | 9/1973 | Chadwick et al. | 83/177 |
| 3,841,025 | 10/1974 | Maeda | 451/95 |
| 4,573,382 | 3/1986 | Kloehn et al. | 83/177 X |
| 4,607,794 | 8/1986 | Horwood | 239/455 |
| 4,686,877 | 8/1987 | Jaritz et al. | 83/53 X |
| 4,693,153 | 9/1987 | Wainwright et al. | 83/53 |
| 4,827,679 | 5/1989 | Earle, III | 83/53 X |
| 4,966,059 | 10/1990 | Landeck | 83/177 X |
| 5,199,342 | 4/1993 | Hediger | 83/53 X |
| 5,318,395 | 6/1994 | Driver | 83/177 X |
| 5,367,929 | 11/1994 | Burch et al. | 83/177 |

*Primary Examiner*—M. Rachuba
*Attorney, Agent, or Firm*—Shook, Hardy & Bacon LLP

[57] ABSTRACT

A deflector device is provided for a liquid-jet cutter wherein the cutting element is mounted upon an assembly which moves the cutting element between cutting and idle positions. A deflector disk is located on the lower end of this support assembly as maintained in a stationary position immediately below the idle position. During operation, the cutting element is moved to a cutting position immediately adjacent the product support surface which provides products to be cut to the cutter. When it is desirable to halt cutting, the cutting element is moved to a position remote from the product support surface and above the deflector disk. The assembly utilized to control movement of the cutting element positions the cutter at a remote distance from the deflector disk when in an idle state to minimize wear upon the components. The assembly supporting the cutting element further enables the cutter to be located at an extremely close tolerance to the product support surface without concern for the need to locate a deflector therebetween. The present deflector mechanism removes the need for a valve assembly within the cutting element.

14 Claims, 2 Drawing Sheets

DEFLECTOR MECHANISM FOR LIQUID-JET CUTTER

FIELD OF THE INVENTION

The present invention generally relates to a system for effecting liquid-jet cutting, and more particularly, to a deflector mechanism for controlling the cutting operation of the liquid-jet.

BACKGROUND OF THE INVENTION

Systems have been proposed for cutting and trimming various types of products, such as food products, through the use of highly focused and highly pressurized jets of liquid (referred to as "liquid-jet cutting"). During implementation, the cutting device is located upon a robotic arm proximate a conveyance system which brings the product to be cut in close proximity to the cutting device. Thereafter, the cutting device directs a high pressure jet of liquid onto the product to cut the product. Past cutting systems utilize valves which open and close to turn the liquid-jet on and off. However, such systems were undesirable since the valves operate slowly and require an unduly long time period to open and close. The slow operating speed was at least partially attributed to the fact that the valve was a "flow through" type of valve, wherein the valve sealed an opening therethrough against the high pressure liquid-jet when closed. Such valves are necessarily large and heavy in order to halt the liquid-jet and withstand the high pressures used in liquid-jets. The size and mass associated with such valves limit their reaction speed. Additionally, the mass of the valve reduces the cutting capacity of the robotic arm which supports the cutting device and moves same during operation.

To overcome the foregoing disadvantages of the flow-through type of valve, a "deflector" type of valve has been proposed. The conventional deflector valve includes a flat deflector bar located proximate the discharge end of the nozzle of the liquid-jet cutting device. The deflector bar is rectangular in shape and is supportably mounted at an inner end to the drive shaft of a pneumatic rotary cylinder. The pneumatic rotary cylinder is mounted to the system's frame and oriented with its rotational axis aligned parallel to the path of the liquid-jet stream. The rotary cylinder drivably pivots the bar-shaped deflector along an arcuate path within a plane perpendicular to the path of the jet, such that an outermost end of the bar moves between engaged and disengaged positions. When the bar-shaped deflector is in an engaged position, its outer end is located immediately below the nozzle to block the path of the liquid-jet sprayed therefrom. When in a disengaged position, the outer end of the bar-shaped deflector is located remote from and does not interfere with the liquid-jet path.

However, the conventional deflection method has met with limited success. In this conventional system, the nozzle of the liquid-jet and the deflector bar are maintained a fixed vertical distance from one another when engaged and disengaged. The nozzle must be located sufficiently close to the product to achieve the desired cutting effect. To interrupt a cutting operation, the deflection bar is rotated to rest between the nozzle and the product. However, as the nozzle must be located close to the product, so must the deflector plate be located close to the nozzle to afford the least possible operating range between the nozzle and the product. Otherwise, the cutting device becomes inoperative since, as the distance between the nozzle and deflector bar increases, the distance between the nozzle and product must necessarily increase, which reduces the cutting efficiency.

Due to these space limitations, the deflection plate must be rotated to a position immediately adjacent the nozzle to deflect the water, and thus the liquid-jet wears substantially upon the deflection bar. The conventional system attempts to minimize this wearing factor by providing an insert at the outer end of the deflection bar formed of an extremely hard material to receive the direct stream of the liquid-jet. However, the insert still wears, thereby affording a short life for the deflection mechanism.

In addition, the conventional deflector mechanism limits a minimum operating distance between the nozzle and the product since the deflector bar must be afforded space to rotate between the nozzle and the product. This minimum operating distance is insufficient to allow optimal cutting and accuracy.

Further, the conventional deflector mechanism produces a tremendous volume of liquid spray emitted in all directions from the point of contact with the product or deflector bar, thereby reducing visibility in the region of the nozzle. Moreover, the conventional deflector mechanism repetitively directs the liquid-jet onto the deflector bar at a single point. Hence, the bar wears quickly at the point of contact and must be changed quite often.

A need remains within the industry for an improved deflector mechanism. The present invention meets this need and overcomes the disadvantages of the above-noted systems.

SUMMARY OF THE INVENTION

It is an object of the present invention to provide a deflector mechanism which undergoes minimal wear during operation to provide a lengthened life.

It is a further object of the present invention to provide a cutting device which may be moved between cutting and idle positions which correspond, respectively, to a minimum operating distance between the nozzle and the product during a cutting operation and to a maximum idle distance between the nozzle and the deflection platform.

It is a further object to reduce the liquid spray or fog generated by the cutting mechanism to improve visibility.

It is an object of the present invention to provide a deflector mechanism which may be located between the cutting device and the product to be cut during idle time periods, with a distance between the cutting device and the deflector platform maximized to reduce wear.

It is a corollary object of the present invention to provide a cutting device which may be moved to a position as close as desirable to the product independent of the deflector mechanism.

It is a further object of the present invention to provide a deflector mechanism which lengthens the life of the nozzle and the cutting device.

It is another object of the present invention to increase the life of the deflector platform by including replaceable wear disks which rotate throughout use to wear evenly along a concentric circle.

It is a corollary object of the present invention to provide a deflector mechanism having an easily replaceable wear disk.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 3:
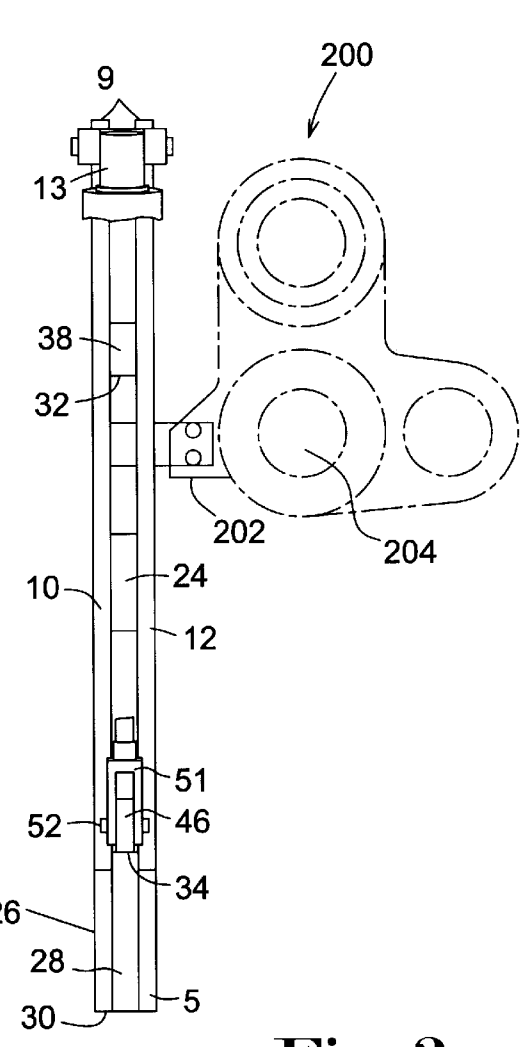
FIG. 3 illustrates an end view of a deflector mechanism according to the present invention taken along line 3—3 in FIG. 1.
Figure 1:
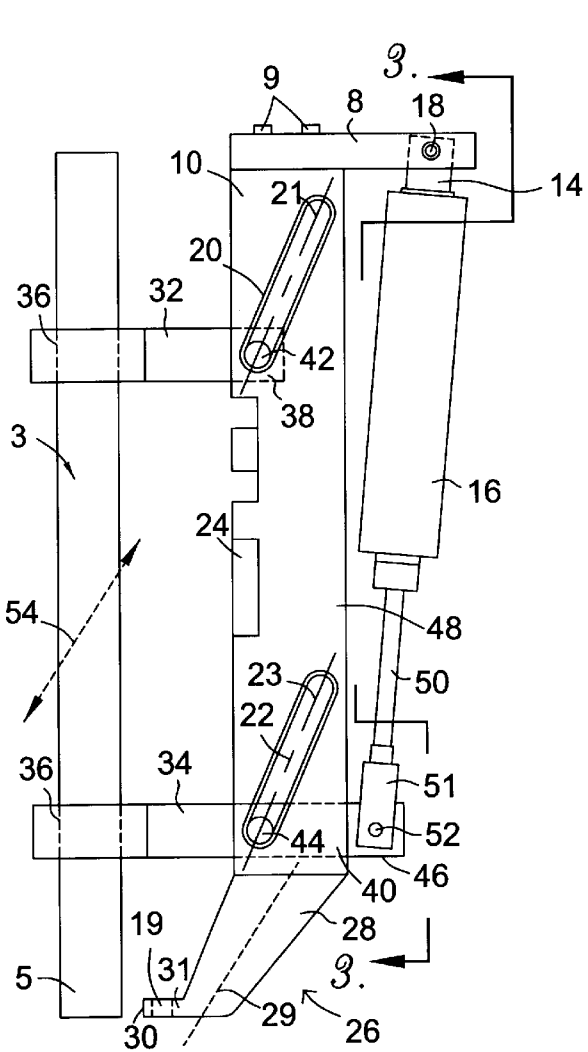
FIG. 1 illustrates a side view of a deflector mechanism according to the present invention with the cutting device located in a cutting position and without a splash guard.

FIG. 1 generally illustrates a cutting device, such as a liquid-jet cutter, identified by the reference numeral 1. The cutting device is mounted to a robotic support framework (generally identified as element 200 in FIG. 3) and is suspended above a product support or conveyance surface 4. In the preferred embodiment, the conveyance surface 4 delivers the product to be liquid-jet cut into proximity with the cutting device 1, while the robotic support framework aligns the device with the product. The device may be mounted to the framework in a variety of ways, such as via side brackets or a top bracket 202 (as shown in dashed lines in FIG. 3). This bracket 202 slides along a support tube 204 aligned transverse (at approximately a 45° angle) to the product conveying path. The 202 bracket is slid across the conveying path to align the cutting device with the product 100 as the product is moved along the conveyor. The device includes side braces constructed as rectangular brackets 10 and 12 (FIG. 3) aligned parallel and juxtaposed to one another with the longitudinal axes thereof aligned perpendicular to the conveyance surface 4. Optionally, the brackets 10 and 12 may be aligned in a vertical or non-vertical plane. The upper ends of the brackets 10 and 12 are secured to an upper base 8, such as via screws 9. The base 8 maintains the brackets 10 and 12 in a spaced relation from one another by a set distance for reasons explained below. The base 8 includes a rear end, projecting rearward of the brackets 10 and 12, and including a forked notch 13 (FIG. 3) cut therein. The notch 13 pivotally receives a rear end 14 of a cylinder 16 secured thereto via pin 18. Each of the side brackets 10 and 12 include upper and lower slots 20 and 22 therein. The slots 20 and 22 within each side bracket are formed along longitudinal axes 21 and 23 extending parallel to one another and at an acute angle to the longitudinal axes of the brackets 10, 12. In the embodiment of FIG. 1, the vertical axes extends along the length of the side brackets 10 and 12. The slots within the first bracket 10 are aligned with corresponding slots in the second bracket 12.

Optionally, a spacer 24 is provided at an intermediate point along the brackets 10 and 12 and located therebetween to maintain the desired spaced relation between the brackets. The spacer 24 is secured to both brackets, such as with bolts. The lower ends of both brackets 10 and 12 are further securely mounted to a deflection disk elbow 26 having an upper base section 28 and a lower disk platform 30. The base section 28 is mounted to the lower ends of the side brackets 10 and 12 to maintain the desired spaced relation therebetween. The base section 28 projects downward from the side brackets 10 and 12 along an axis 29 forming an acute angle with respect to the conveyance surface 4. The disk platform 30 projects horizontally outward and forward from the base 28. The disk platform 30 includes a hole 31 therethrough which slidably receives a circular wear disk 19 which functions to deflect the liquid-jet stream, and thus prevent cutting, when the device is located in an idle position (as illustrated in FIG. 2).

A cutting element 3 is provided adjacent the side brackets 10 and 12 and is mounted thereto via upper and lower support arms 32 and 34. The support arms 32 and 34 may be constructed with a rectangular body having a flared front end. The upper and lower support arms 32 and 34 are provided with holes 36 through the outer flared ends thereof to receive the cutting element 3. The cutting element 3 may be secured to the arms 32 and 34 in a variety of ways, such as with a set screw extending through the arms at a point proximate the holes and frictionally engaging the cutting element 3. While not shown, the upper end of the cutting element 3 receives a liquid supply hose which delivers pressurized liquid to the cutting element 3. The liquid passes along a passage through the cutting element 3 and is discharged from a nozzle 5 at the lower end thereof.

The upper and lower support arms 32 and 34 include rectangularly shaped rearward ends 38 and 40, each of which includes flat sides slidably received between the side brackets 10 and 12. The rear ends 38 and 40 are formed with a thickness substantially conforming to the set distance between the brackets 10 and 12 in order that the brackets properly guide the arms and cutting element 3 along a precise path. The rearward ends 38 and 40 further include guide pins 42 and 44 extending laterally from opposite sides thereof. The guide pins 42 and 44 are slidably captured within the slots 20 and 22 within the brackets 10 and 12 providing a means for guiding the support arm along a desired path. In this manner, the pins and slots define the path of movement for the cutting element 3. The rear end 40 of the lower support arm 34 includes a driven blade 46 extending beyond the rear sides 48 of the brackets 10 and 12. The blade 46 is pivotally secured within a bail 51 on the outer end of the ram 50 within the cylinder 16 via a pin 52.

Figure 2:
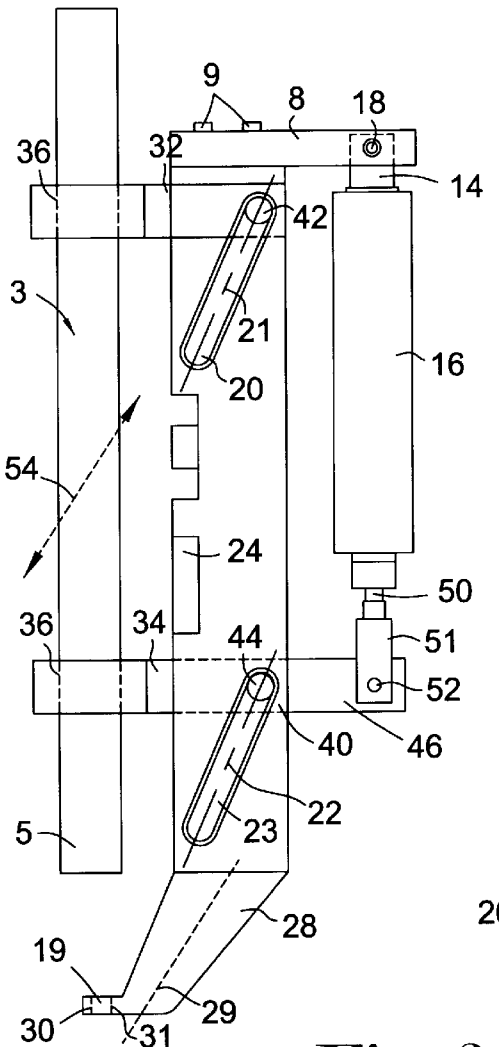
FIG. 2 illustrates a side view of a deflector mechanism according to the present invention with the cutting device located in an idle position and without a splash guard.

During operation, the cylinder 16 drives the cutting element 3 between a cutting position (as shown in FIG. 1) and an idle position (as shown in FIG. 2). In more detail, when the cylinder 16 is extended, the ram 50 drives the lower support arm 34 downward, thereby directing the nozzle 3 to move along an angular path (outlined by arrow 54) in a direction parallel to the longitudinal axis 21 and 23 of the slots 20 and 22. The pins 42 and 44 guide the upper and lower support arms 32 and 34 forward and downward to similarly guide the movement of the cutting element 3. The cylinder 16 continuously extends until ram 50 is completely extended and/or the pins 42 and 44 reach the lower ends of the slots 20 and 22. When the pins "bottom out" within the slots 20 and 22, the cutting element 3 is located at the cutting position immediately above a desired point upon the horizontal plane defined by the conveyance surface 4. The robotic support framework moves the device 1 along the x-axis and y-axis of this horizontal plane. The pins 42 and 44, when bottomed out, further ensure that the nozzle 5 is located a predefined precise distance from the conveyance surface, thereby ensuring that the nozzle 5 is located a cutting distance $D_{OUT}$ from the product 100. The cutting distance $D_{OUT}$ falls within an acceptable cutting range by insuring that the nozzle 5 is at a set distance from the conveyance surface. For example, the nozzle 5 may operate effectively so long as the cutting distance $D_{OUT}$ does not exceed a predetermined number of inches between the nozzle 5 and product 100. The cutting distance $D_{OUT}$ may be very large or very small depending upon the thickness of the product. In this manner, the pins 42 and 44 and slots 20 and 22 precisely locate the nozzle 5 within an optimal range from to the product to be cut. As is clear in FIG. 1, when the nozzle 5 is at a cutting position, the center of the disk platform 30 is located a lateral distance $D_{LATERAL}$ remotely to one side of the center of the jet stream.

When it is desirable to halt a cutting operation, the cutting element 3 is moved to an idle position (as shown in FIG. 2). To do so, the cylinder 16 retracts the ram 50 thereby drawing the support arms 32 and 34 upward and rearward along the path defined by the slots 20 and 22 and the pins 42 and 44. The cylinder 16 commands upward movement of the cutting element 3 until the pins reach the upper ends of the slots or the ram 50 completely retracts. While at this idle position, the nozzle 5 is located above the conveyance surface 4 by an idle distance $D_{IDLE}$, and above the disk platform 30 by a deflector distance $D_{DEFL}$. The deflector distance $D_{DEFL}$ is set sufficiently large to minimize the wearing forces upon the disk platform 30 effected by the liquid-jet. The invention enables the minimum cutting distance $D_{OUT}$ to be less than the deflector distance $D_{DEFL}$ (such as when cutting thick product). By locating the nozzle 5 a deflector distance $D_{DEFL}$ from the disk platform 30, the invention increases the nozzle life, increases the disk life and provides more reliable performance since the deflected liquid sprays outward from the disk section 30 with less destructive energy as compared to the prior art systems.

In the embodiment of FIG. 1, the nozzle 5 is moved, via the cylinder 16, along a path generally designated by the reference numeral 54 which forms an acute angle to the longitudinal axis of the brackets 10 and 12 and to the horizontal plane of the conveyance surface 4. This path of movement 54 extends parallel to the longitudinal axes of the slots 20 and 24 (generally designated by the reference numeral 21 and 23). The brackets 10 and 12 maintain a close tolerance with the support arms 32 and 34 to ensure smooth and controlled movement of the cutting element 3 between cutting and idle positions.

It is to be understood that the physical construction of the present invention may be varied, so long as the cutting element 3 is movably supported relative to a deflector disk platform to deflect the liquid-jet when the cutting element is located in an idle position. The deflector disk elbow 26 may be constructed in a variety of arrangements, so long as a disk platform 30 is provided below the nozzle 5 by a deflector distance $D_{DEFL}$ when the cutting element 3 is located in an idle position and so long as the disk elbow 26 does not interfere with the angular movement of the cutting element 3 along the path 54.

Optionally, the side brackets 10 and 12 may be omitted and a single bracket substituted therefor. The rearward ends of the support arms 32 and 34 would be modified in this instance to form bales which receive the single bracket therein. The single bracket may include upper and lower slots similar to those of FIGS. 1 and 2, with the U-shaped bale upon the support arms including lateral pins passing through the slots to effect guidance similar to that illustrated in FIGS. 1 and 2.

As a further alternative, the pins and slots 42 and 44 and 20 and 22 may be reversed, such that the support arms 32 and 34 include slots in the rearward ends 38 thereof which move along stationary upper and lower pins mounted to and extending between the side brackets 10 and 12.

As a further alternative, the slots 20 and 22 may be configured in an arcuate path when it is desirable to move the nozzle 3 along such an arcuate path. In this alternative, the slots 20 and 22 may be formed in an arcuate path with the concaved portion of each path directed downward, such that the nozzle 3 moves from an idle position outward and downward along an arcuate path to a cutting position. This arcuate non-linear motion may simplify the deflector design by moving the nozzle 5 along an arcuate path to minimize interference between the nozzle 5 and the deflector disk 30.

Figure 4:
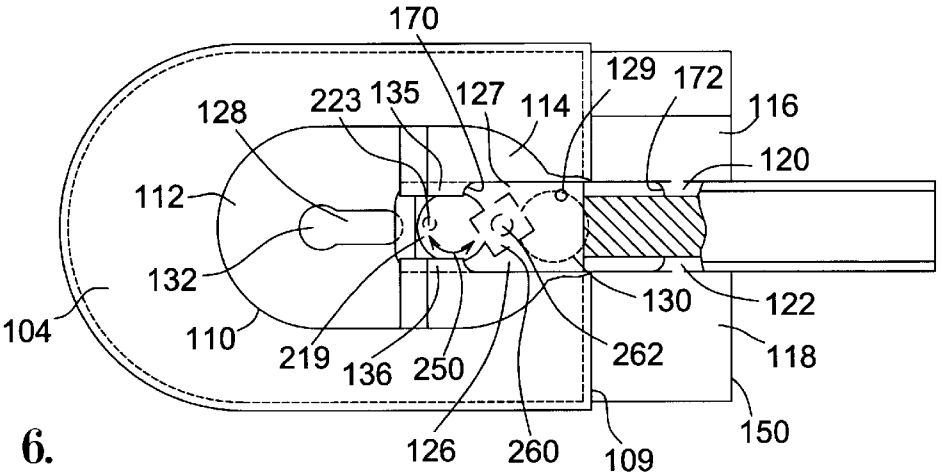
FIG. 4 illustrates a top plan sectional view of the splash guard while mounted to the deflection disk elbow.
Figure 6:
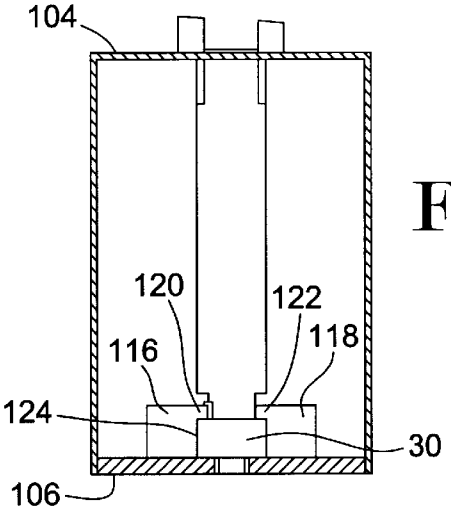
FIG. 6 illustrates a front sectional view of the splash guard while attached to the deflection disk elbow taken along line 6—6 in FIG. 5.
Figure 5:
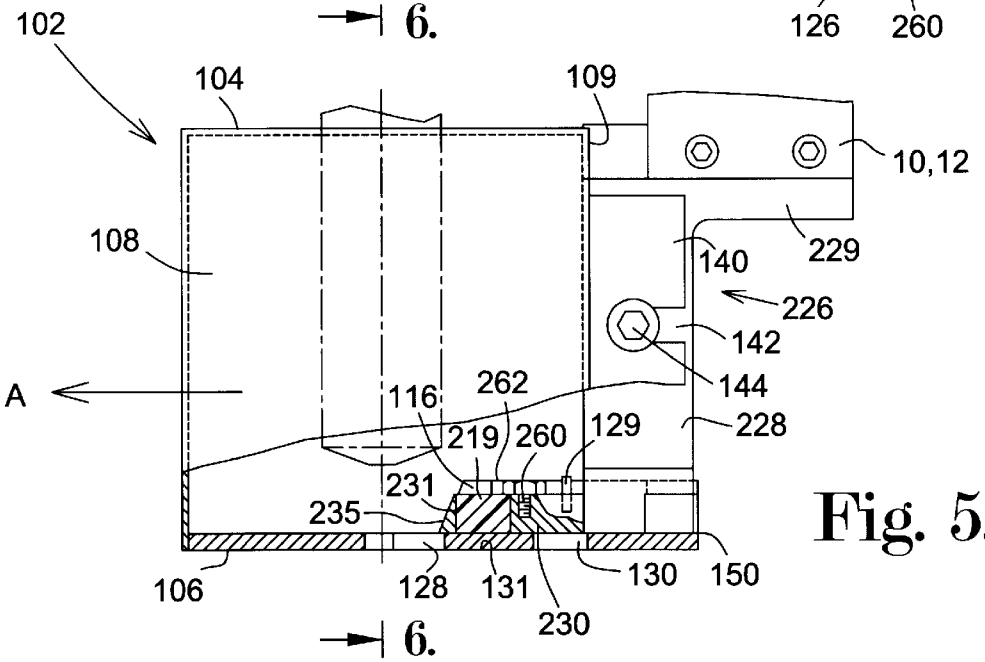
FIG. 5 illustrates a side view of the splash guard and deflection disk elbow.

FIGS. 4–6 illustrate an alternative embodiment in which a deflection disk elbow 226 is constructed with a base section 228 projecting downward from a lateral support 229 secured to a lower end of the side bracket 10 and 12. The base section 228 is securely mounted to a lower disk platform 230 directed outward therefrom at a right angle. The outer end of the platform 230 may include a tapered edge 235. The platform 230 includes a hole 231 therethrough which slidably receives a wear disk 219. The top surface of the platform 230 threadably receives a screw 262 which securely retains a carbide insert 260 upon the platform 230. The insert 260 is rectangular in shape and is oriented such that one of the four corners thereof overlaps the top surface of the wear disk 219 on the side opposite the point 223 at which the liquid-jet contacts the disk 219. The insert 260 retains the disk 219 within the hole 231.

As a further option, the cutting device 1 may include a cup-shaped splash guard which retains the water spray and fog generated by the water jet when it contacts the product 100 to be cut or the disk platform 230. The splash guard 102 is constructed from an elongated tubular cylinder having an oval-shaped cross-section. The splash guard 102 includes a top wall 104 and a base 106 which are joined by a continuous side wall 108. The top wall 104 includes an oval-shaped recess 110 (FIG. 4) therein which loosely receives the nozzle 5 throughout operation. The oval recess 110 includes a longitudinal axis which extends horizontally and which is located within a vertical plane defined by the path along which the cutting element 3 moves (i.e., a vertical plane containing the arrow 54). The oval-shaped recess 110 includes a cutting end 112 and an idle end 114. The lower end of the cutting element 3 is located proximate the cutting end 112 when in the cutting position (FIG. 5). The lower end of the cutting element 3 is located at the idle end 114 when in the idle position.

Turning to FIG. 4, the base 106 of the splash guard 102 is described in more detail hereafter. The base 106 includes support rails 116 and 118 projecting upward therefrom and extending along opposite sides of the longitudinal axis described above. The rails 116 and 118 extend from a rear end 150 of the base 106 to an intermediate point between the cutting and idle positions. The support rails 116 and 118 include inner flanges 120 and 122 (FIG. 6) extending along the facing inner upper edges of the rails 116 and 118. The inner flanges 120 and 122 define a recess 124 therebetween. The recess 124 slidably receives the disk platform 230. As viewed from above in FIG. 4, the flanges 120 and 122 include U-shaped recesses 126 and 127 cut therein. The recesses 126 and 127 extend along a center region of each flange 120 and 122. The recesses 126 and 127 are directed toward one another to provide a wider void between the flanges 120 and 122 behind the idle position, while forward lips 135 and 136 upon each flange 120 and 122 are directed toward one another to provide a narrow space therebetween at the idle position.

Optionally, at least one of the recesses 126 and 127 slidably receives a pin 129 (FIG. 5) that is securely mounted within a journalled opening in the upper surface of the disk platform 30. The pin 129 projects upward from the platform 30 and slides along the recess 126 (FIG. 4) as the splash guard 102 is moved relative to the platform 30. The pin 129 contacts opposite ends 170 and 172 of the recess 126 to define limits of acceptable motion between the guard 102 and platform 30. In this manner, the pin 129 and recess 126 cooperate to prevent the guard 102 from being completely removed from the platform 30, while allowing the wear disk 219 to be positioned below the lips 135 and 136, and the recesses 126 and 127.

As illustrated in FIG. 5, the base 106 further includes a cutting hole 128 (FIG. 4) to allow the liquid-jet to pass through the base 106 when the nozzle 5 is located proximate the cutting position. When the cutting element 3 is located proximate the cutting end 112 of the guard 102, the liquid-jet projects through a flared end 132 (FIG. 4) of the cutting hole 128. When the cutting element 3 is located proximate the idle end 114 of the guard 102, the water jet is directed onto the wear disk 219.

The base 106 includes a disk replacement hole 130 (FIG. 5) therethrough proximate the center of the base 106. When the splash guard 102 is slid outward along the platform 230 in the direction of arrow A (FIG. 5), the hole 130 is moved to align with the hole 231 through the platform 230. The holes 231 and 130 have substantially equal diameters such that, when aligned with one another, the wear disk 219 is allowed to pass downward through the disk replacement hole 130. In this manner, the wear disk 219 may be replaced without completely disassembling the device. As the guard 102 is moved outward to align holes 130 and 231, the pin 129 and recess 127 prevent the rails 116 and 118 from totally disengaging the platform 230.

Turning to FIG. 5, the splash guard 102 further includes a side bracket 140 secured to, and extending rearward, from an intermediate point along a rear wall 109 of the guard 102. The bracket 140 extends rearward along one side of the base section 228. The side bracket 140 includes a notch 142 in the outer edge thereof and at an intermediate point along its height. The notch 142 aligns with a threaded hole in the side of the base section 228. When the splash guard 102 is slidably mounted upon the disk platform 230, and in an operative position, the notch 142 aligns with the threaded hole. A screw 144 is screwed into the threaded hole to secure the bracket 140 to the base section 228, thereby maintaining the splash guard 102 in its operative position. When aligned in this manner, the base 106 is aligned such that a support region 131 between the holes 128 and 130 aligns with the bottom of the hole 231 through the disk platform 231. The support region 131 and lips 135 and 136 cooperate to maintain the replacement disk 219 within the disk platform 230.

The replacement disk 219 is loosely received within the hole 231 in the platform 230 and is aligned, such that the liquid-jet contacts the replacement disk 219 at a point 223 (FIG. 4) radially outward from the center of the disk 219. By aligning the liquid-jet and the wear disk 219 in this off-axial alignment, the disk 219 tends to rotate along a path 250 about the vertical central axis of the disk 219 when the nozzle 5 is located at the idle position and directs the liquid-jet at point 223. As the wear disk 219 rotates, the water jet wears a concentric ring therein. Once the disk 21 is eroded to a maximum depth, it is replaced by sliding the splash guard 102 outward to align the hole 130 with the hole 231 through the disk platform 230.

It is further noted that the cutting device may operate in any orientation. The product support surface 4 need not be horizontal, but may be oriented vertically or at some other angle.

Optionally, the hose supplying pressurized liquid to the cutting element 3 may contain a coiled section immediately above the cutting element 3 to minimize wear within the hose when the cutting element 3 is moved between cutting and idle positions.

Optionally, delrin inserts 17 may be placed between the support brackets 32 and 34, and the side brackets 10 and 12. The delrin inserts 17 may extend into and conform to the inner perimeter of the slots 20 and 22. In the preferred embodiment, four inserts 17 are used.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A liquid-jet cutting device comprising:

a cutting element for emitting a liquid-jet stream to cut a product located upon a product support surface;

an assembly for moving the cutting element between a cutting position located a cutting distance, within a cutting range, from the product and an idle position located an idle distance from the product support surface; and a deflector disk, located proximate the idle position of the cutting element, to deflect the liquid-jet stream when the cutting element is moved to the idle position.

2. A device according to claim 1, wherein the deflector disk is maintained in a fixed position with respect to the cutting position at all times, while the cutting element is moved with respect to the cutting position when moved between the cutting and idle positions.

3. A device according to claim 1, wherein said cutting distance is less than said idle distance.

4. A device according to claim 1, wherein the cutting element includes a nozzle, from which the liquid-jet is emitted, said nozzle being located remotely to one side of the deflector disk where the liquid jet stream does not hit the deflector disk when in a cutting position, and said nozzle being located remote from said deflector disk and vertically above said deflector disk where the liquid-jet stream hits the deflector disk when in an idle position.

5. A device according to claim 1, wherein said cutting element is moved between the cutting and idle positions along a linear path forming an acute angle to a horizontal plane formed by the product support surface.

6. A device according to claim 1, wherein said assembly includes at least one bracket extending along a vertical axis perpendicular to the product support surface, said deflector disk projecting downward and forward from a lower end of said bracket, said deflector disk having a lower disk platform extending horizontally forward from the bracket to a position between the product support surface and a nozzle of the cutting element when the cutting element is located at the idle position.

7. A device according to claim 1, wherein the deflector disk is maintained in a stationary position with respect to the device at all times while the cutting element is moved relative to the device between cutting and idle positions.

8. A device according to claim 1, wherein a minimum cutting distance is less than a deflector distance extending between the deflector disk and the cutting element in the idle position.

9. A device according to claim 1, wherein said deflector disk includes a wear disk located to receive the liquid-jet at a point upon the wear disk to one side of a center of the wear disk, said wear disk being loosely received within a hole in the deflector disk, said wear disk rotating when contacted by the liquid-jet stream to form a concentric wearing upon an upper surface of said wear disk.

10. The device according to claim 4, wherein the nozzle is located closer to the product than the deflector disk.

11. A liquid-jet cutting device comprising:

a cutting element for emitting a liquid-jet stream to cut a product located upon a product support surface;

an assembly for moving the cutting element between a cutting position located a cutting distance, within a cutting range, from the product and an idle position located an idle distance from the product support surface;

a deflector disk, located proximate the idle position of the cutting element, to deflect the liquid-jet stream when the cutting element is moved to the idle position; and a cylinder having a base attached to said assembly and a ram attached to said cutting element, said cylinder moving the cutting element to the cutting position when the ram is extended and moving the cutting element to an idle position when the ram is contracted.

12. A device according to claim 11, wherein said assembly comprises:

side brackets aligned juxtaposed to one another and along a vertical axis extending perpendicular to the product support surface;

at least one support arm having a rearward end slidably mounted between said side brackets and having an outer end fixedly mounted to said cutting element, said support arm moving said cutting element between cutting and idle positions; and means for guiding said support arm along a desired path with respect to said side brackets.

13. A device according to claim 12, wherein said means for guiding includes a plurality of slots formed in said side brackets and an equal plurality of pins mounted upon said support arm, said pins moving within said slots to guide motion of the cutting element.

14. A liquid-jet cutting device comprising:

a cutting element for emitting a liquid-jet stream to cut a product located upon a product support surface;

an assembly for moving the cutting element between a cutting position located a cutting distance, within a cutting range, from the product and an idle position located an idle distance from the product support surface;

a deflector disk, located proximate the idle position of the cutting element, to deflect the liquid-jet stream when the cutting element is moved to the idle position; and a splash guard mounted to said assembly, said splash guard including side walls surrounding the deflector disk and a top plate having a recess which receives said cutting element.

* * * * *